US006515427B2

(12) United States Patent
Oura et al.

(10) Patent No.: US 6,515,427 B2
(45) Date of Patent: Feb. 4, 2003

(54) INVERTER FOR MULTI-TUBE TYPE BACKLIGHT

(75) Inventors: Hisaharu Oura, Kikuchi-gun (JP); Hironori Takaoka, Kikuchi-gun (JP)

(73) Assignee: Advanced Display Inc., Kikuchi-gun (JP)

( * ) Notice: Subject to any disclaimer, the term of this patent is extended or adjusted under 35 U.S.C. 154(b) by 0 days.

(21) Appl. No.: 09/991,646

(22) Filed: Nov. 26, 2001

(65) Prior Publication Data

US 2002/0047619 A1 Apr. 25, 2002

(30) Foreign Application Priority Data

Dec. 8, 2000 (JP) ..... 2000-373920

(51) Int. Cl.[7] ..... H05B 41/24
(52) U.S. Cl. ..... 315/141; 315/144; 315/220
(58) Field of Search ..... 315/141, 142, 315/144, 219, 220, 224, 225, 291, 307

(56) References Cited

U.S. PATENT DOCUMENTS 5,822,201 A * 10/1998 Kijima ..... 363/25

FOREIGN PATENT DOCUMENTS

JP 408045679 A * 2/1996

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

The inverter for multi-tube type backlight includes two step-up transformers of one-side grounded type, wherein the two step-up tranformers respectively output electric power to one or a plurality of cold cathode tubes, and wherein outputs of the two step-up tranformers are of identical frequency but of mutually reversed phases.

4 Claims, 9 Drawing Sheets

INVERTER FOR MULTI-TUBE TYPE BACKLIGHT

BACKGROUND OF THE INVENTION

The present invention relates to an inverter for multi-tube type backlight.

A liquid crystal display panel (LCD) is generally comprised with a backlight as a light source wherein such a backlight is mainly comprised of cold cathode tubes. In case display of high luminance is to be required, a plurality of cold cathode tubes are employed as the backlight for comprising a multi-tube type backlight.

High voltage is required for illuminating cold cathode tubes, and an inverter is used as a light source for illumination. A frequency of a voltage that is supplied to the cold cathode tubes, that is, an oscillating frequency for the inverter generally ranges from 30 to 80 kHz. A step-up transformer for the inverter is mainly used upon one-sided grounding for the purpose of keeping high voltage wirings for connecting outputs of the inverter with the cold cathode tubes short.

A conventional circuit of an inverter for a multi-tube type backlight is illustrated in FIGS. 5, 6 and 7.

In the inverter of FIG. 5, a push-pull type resonance circuit is provided on a primary side of the step-up transformer 11 that is comprised of transistors 7 and 8, a resonance capacitor 9, a choke coil 13 and a primary winding of the step-up transformer 11. Alternating current of high frequency that is generated by this resonance circuit is stepped up by the step-up transformer 11 and is supplied to both cold cathode tubes 3, 4. Since the cold cathode tubes 3, 4 are of negative voltage-current characteristics, ballast capacitors 5, 6 are provided for the purpose of limiting current. One end of a secondary winding of the step-up transformer is grounded so as to achieve so-called one-sided grounding.

The inverter of FIG. 6 is comprised of two step-up transformers 11, 12 that are respectively connected to the cold cathode tubes 3, 4. A primary-side resonance circuit is commonly used by the step-up transformers 11, 12. The step-up transformers 11, 12 are of one-sided grounded type.

Similarly to the inverter of FIG. 6, the inverter of FIG. 7 is also comprised of two step-up transformers 11, 12 that are respectively connected to the cold cathode tubes 3, 4. However, the inverter of FIG. 7 differs from the inverter of FIG. 6 in that separate resonance circuits are provided on primary sides of the step-up transformers 11, 12, respectively. The step-up transformers 11, 12 are of one-sided grounded type.

As explained above, the inverters of multi-tube type backlights utilizing a plurality of cold cathode tubes employ either a method in which a plurality of cold cathode tubes are connected to an output of a step-up transformer (FIG. 5) or a method in which a plurality of step-up transformers are used (FIGS. 6, 7).

In case a plurality of cold cathode tubes are connected to an output of a step-up transformer (FIG. 5), the plurality of cold cathode tubes are supplied with outputs of identical frequency and of identical phase and thus operate in a synchronous manner. In case a common primary-side resonance circuit is used for a plurality of step-up transformers (FIG. 6), the plurality of cold cathode tubes will similarly operate in a synchronous manner. In case the plurality of step-up transformers is respectively provided with primary-side resonance circuits (FIG. 7), the plurality of cold cathode tubes will operate in an asynchronous manner.

However, the following drawbacks are presented in a conventional inverter for a backlight. More particularly, an inverter outputs alternating current of high voltage and high frequency for illuminating cold cathode tubes such that noise resulting from such high voltage will be mixed into control signals or image signals for driving a liquid crystal display panel. It is known that wavelike display noises appear on liquid crystal display panels that are generally referred to as beat noises through interference between high voltage noises generated from the inverter and horizontal synchronous frequencies of the liquid crystal display panel and other factors, wherein sources of generating such noise are high voltage portions, namely the step-up transformers, high voltage wirings, cold cathode tubes, and also lamp reflectors.

As already described, the high voltage outputs that are supplied to the plurality of cold cathode tubes are synchronous in the inverters of FIGS. 5 and 6. Thus, noise $N_1$ resulting from high voltage output 1 of the step-up transformer 11 and noise $N_2$ resulting from high voltage output 2 of the step-up transformer 12 will also be of synchronous waveforms as illustrated in FIG. 8. Because of this fact, composite high voltage noise N will be inputted to the liquid crystal display panel such that beat noises will appear on a display screen.

In the inverter as illustrated in FIG. 7, the high frequency outputs that are supplied to the plurality of cold cathode tubes are not synchronous. Thus, noise N composed of noise $N_1$ from high voltage output 1 and of noise $N_2$ from high voltage output 2 will be similarly inputted to the liquid crystal display panel so that beat noises will appear on the display screen.

A known method for preventing generation of beat noise is one as illustrated in FIG. 10 in which the step-up transformer is made to perform floating operation instead of one-side grounding the same. In the inverter of FIG. 10, output terminals of the step-up transformer 11 are not grounded but connected to both electrodes of the cold cathode tube 3. Similarly, output terminals of the step-up transformer 12 are connected to both electrodes of the cold cathode tube 4. Since high voltage outputs from respective output terminals of the step-up transformers will be of identical frequency but of reverse phase in such an inverter, the composite high voltage noise will be substantially zero. However, in case such an inverter and cold cathode tubes are mounted as actual products, at least one of two high voltage wirings for connecting the step-up transformers and the cold cathode tubes will be a long one. This will lead to an increase in leak current owing to stray capacity of the high voltage wirings to thus undesirably degrade the efficiency of the inverter.

In the cold cathode tube having a smaller diameter and a longer length, the higher the tube voltage becomes, the more beat noise is apt to be generated owing to its characteristics. It is also apt to be generated in case the high voltage wiring is long, in case an interval between the cold cathode tubes and the liquid crystal display panel is narrow, or also in case shielding properties between high voltage portions and the liquid crystal display panel are not sufficient. Such demands are becoming gradually stricter accompanying the tendency of employing a multi-tube type arrangement for backlights in future liquid crystal display panels for achieving further upsizing, thinning and high luminance thereof.

It is therefore an object of the present invention to prevent generation of noise on a display screen owing to secondary-side high voltage of an inverter without increasing lengths of high voltage wirings.

SUMMARY OF THE INVENTION

For solving the above problems, the inverter for multi-tube type backlight according to the present invention includes two step-up transformers of one-side grounded type wherein the two step-up transformers respectively output electric power to one or a plurality of cold cathode tubes and wherein outputs of the two step-up transformers are of identical frequency but of mutually reversed phases.

More particularly, in an inverter utilizing a Royer's circuit, a primary-side resonance circuit is used in common by two step-up transformers of one-side grounded type, wherein outputs of the two step-up transformers are made to be of identical frequency but of mutually reversed phases by setting the two step-up transformers to be of reverse polarity.

Alternatively, two step-up transformers of one-side grounded type are driven in a push-pull manner through identical switching signals and signals obtained by inverting these switching signals, wherein polarities of the two step-up transformers and switching elements into which the switching signals and the signals obtained by inverting these switching signals are inputted are determined such that outputs of the two step-up transformers are of reverse phase.

Moreover, a plurality of inverters each comprised of two step-up transformers that output electric power of identical frequency but of reverse phases are provided for driving and illuminating a plurality of cold cathode tubes.

DETAILED DESCRIPTIONS

Embodiments of the present invention will now be explained based on the accompanying drawings.

Embodiment 1

Figure 1:
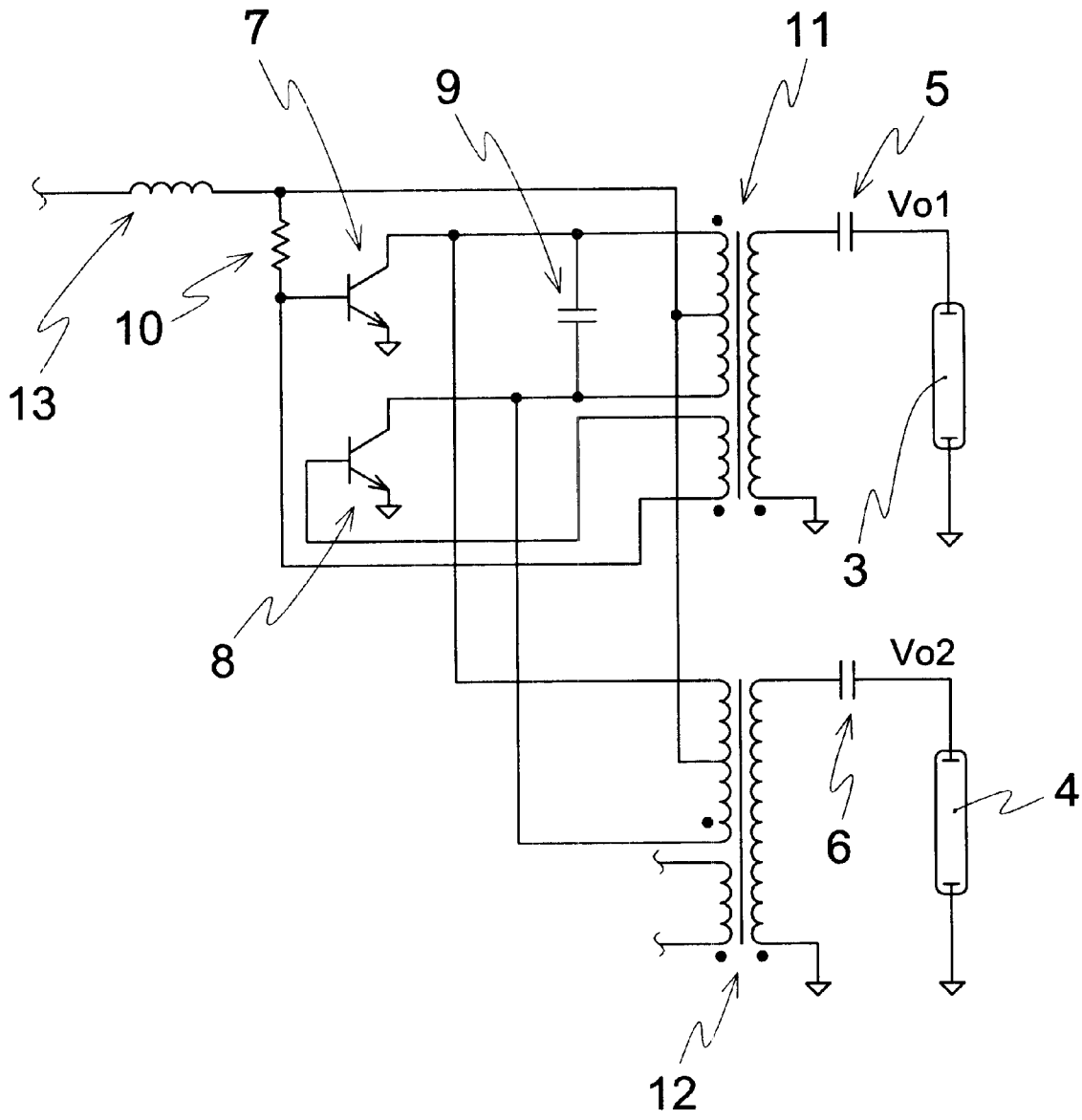
FIG. 1 illustrates a view of a circuit of the inverter according to the first embodiment of the present invention.

FIG. 1 illustrates a view of a circuit of the inverter according to a first embodiment of the present invention. The inverter of the present embodiment is an inverter of self-exciting (oscillating) type utilizing a Royer's circuit.

As illustrated in FIG. 1, the inverter of the present embodiment is comprised of step-up transformers 11, 12, transistors 7, 8, a resonance capacitor 9, and a choke coil 13. Cold cathode tubes 3, 4 are respectively connected to outputs of the step-up transformers 11, 12 through ballast capacitors 5, 6.

Figure 2:
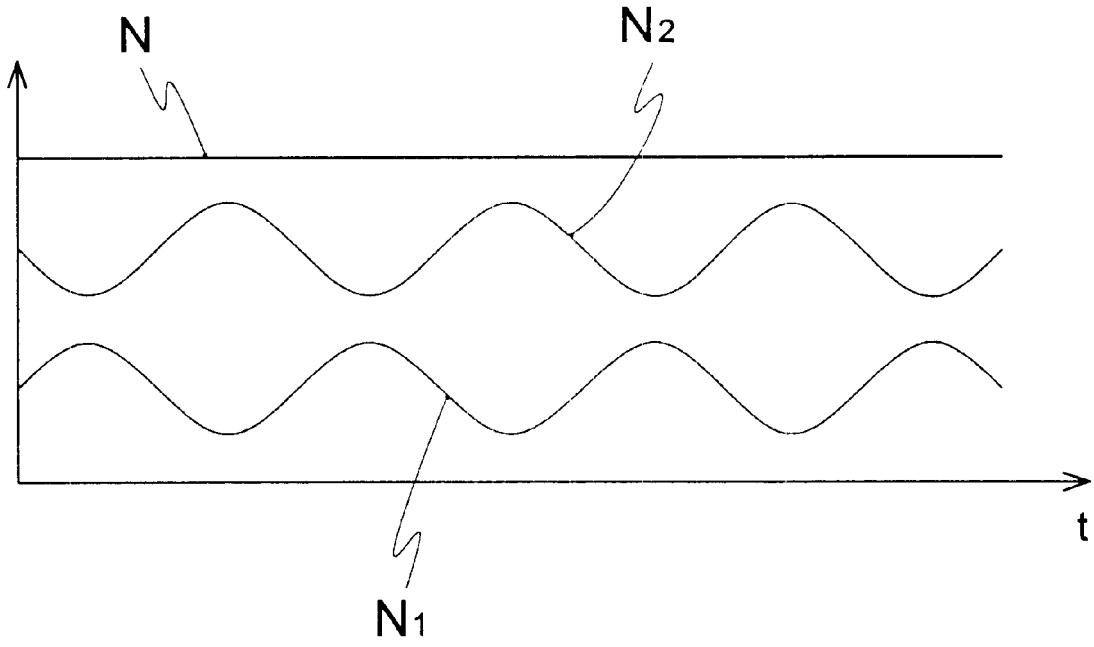
FIG. 2 illustrates high voltage noise waveforms of the inverter of the present invention.

In FIG. 1, the step-up transformer 12 is connected in parallel to the step-up transformer 11 and they share the resonance capacitor 9 in common. A primary winding of the step-up transformer 12 is connected to be of reverse polarity with respect to a primary winding of the step-up transformer 11. Thus, outputs of the step-up transformer 12 are of identical frequency but of reverse phase as outputs of the step-up transformer 11. Since the outputs 1 of the step-up transformer 11 and the outputs 2 of the step-up transformer 12 will be of reverse phase, high voltage noises $N_1$, $N_2$ from both outputs will be cancelled as illustrated in FIG. 2 so that composite high voltage noise N will be substantially zero.

Embodiment 2

Figure 3:
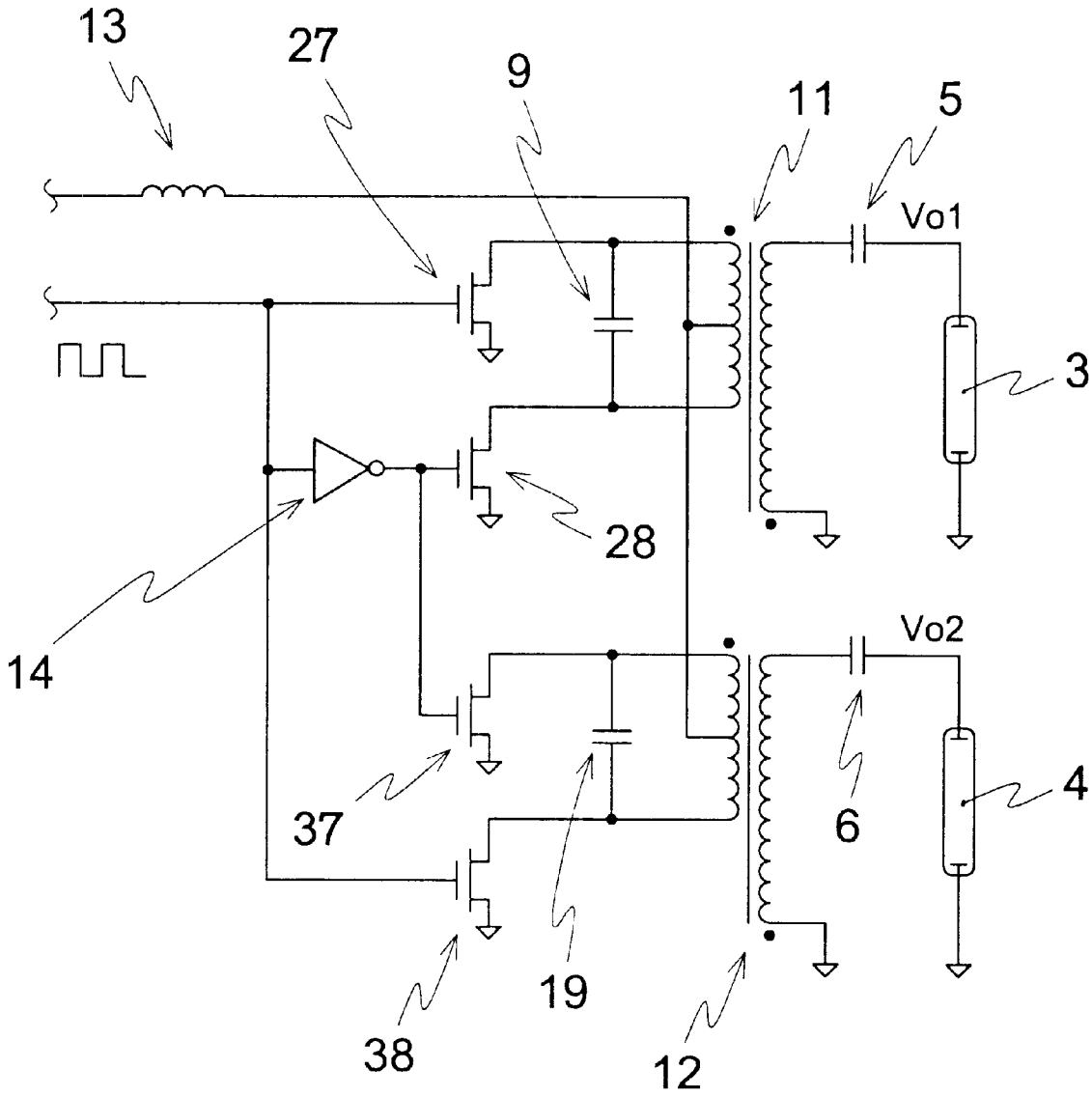
FIG. 3 illustrates a view of a circuit of the inverter according to the second embodiment of the present invention.

FIG. 3 illustrates a view of a circuit of the inverter according to a second embodiment of the present invention. The inverter of the resent embodiment is an inverter of externally excited type.

As illustrated in FIG. 3, the step-up transformer 11 and the step-up transformer 12 of the inverter of the present embodiment are of identical polarity. As switching elements for performing push-pull driving of the step-up transformers 11 and 12, FETs 27, 28 are connected to a primary winding of the step-up transformer 11 whereas FETs 37, 38 are connected to a primary winding of the step-up transformer 12. While identical switching signals are inputted to gates of the FETs 27, 28, 37, 38, the switching signals are inverted through inverter (polarity reversing circuit) 14 prior to input to the FETs 28 and 37. Thus, the step-up transformers 11 and 12 operate at mutually reversed phases. Therefore, outputs from the step-up transformers 11 and 12 will be of identical frequency but of reverse phases so that high voltage noises $N_1$, $N_2$ from both outputs will be cancelled as illustrated in FIG. 2 so that the composite high voltage noise N will be substantially zero.

By setting the step-up transformer 11 and the step-up transformer 12 to be of reverse polarity and employing an arrangement in which inverted switching signals are inputted to FET 28 and FET 38 or FET 27 and FET 37 instead, outputs of both transformers may be set to be of identical frequency but of reverse phases so that the composite high voltage noise N can be substantially made zero.

Embodiment 3

Figure 4:
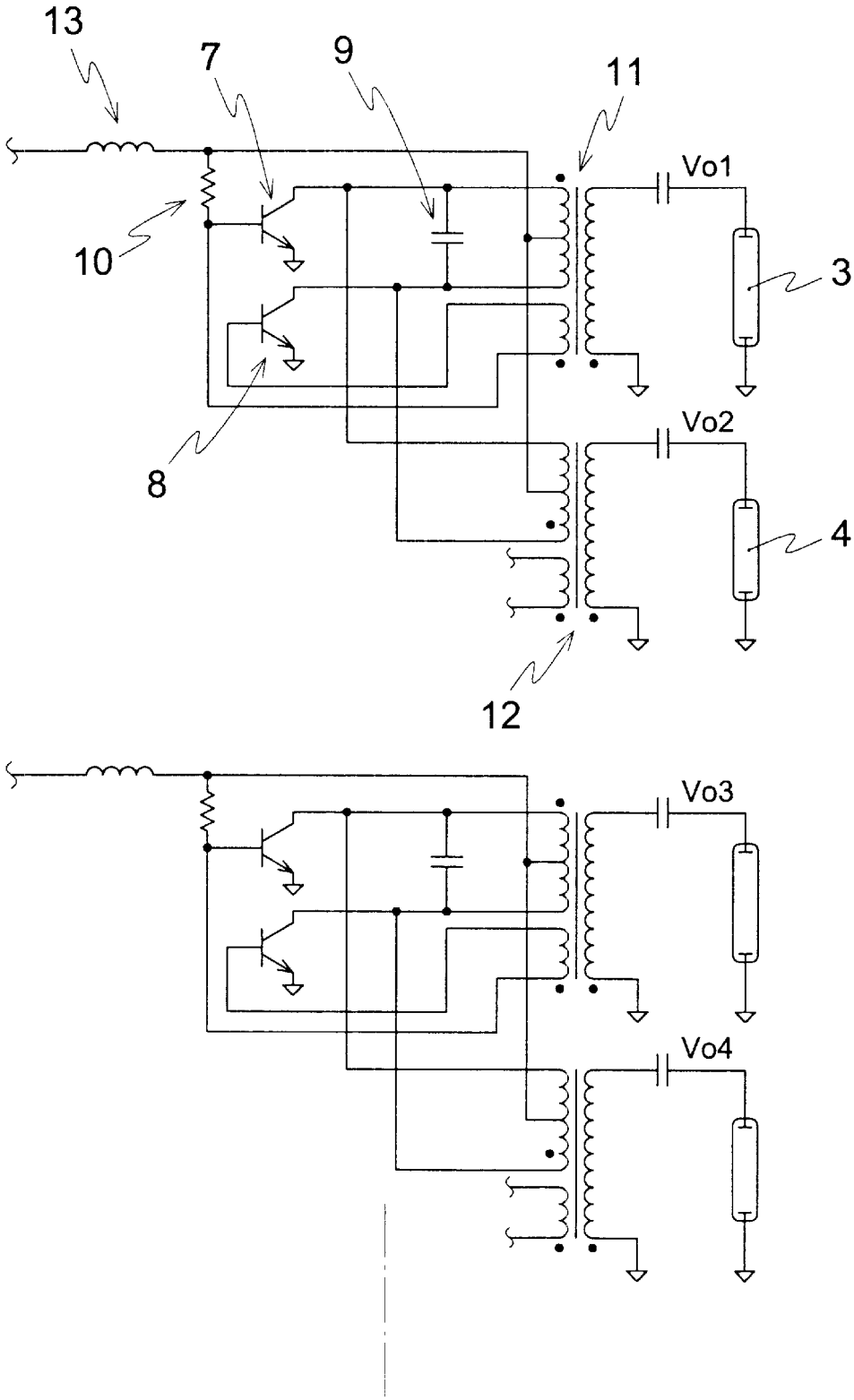
FIG. 4 illustrates a view of a circuit of the inverter according to the fourth embodiment of the present invention.
Figure 5:
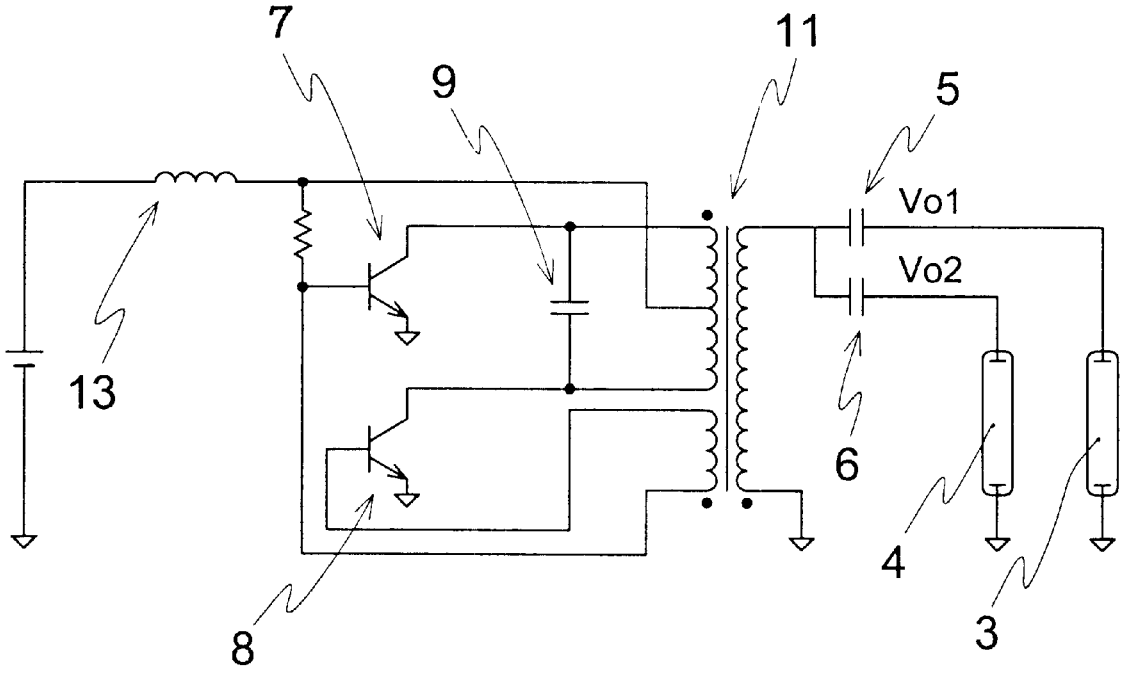
FIG. 5 PRIOR ART
FIG. 5 illustrates a view of a circuit of a conventional inverter.
Figure 6:
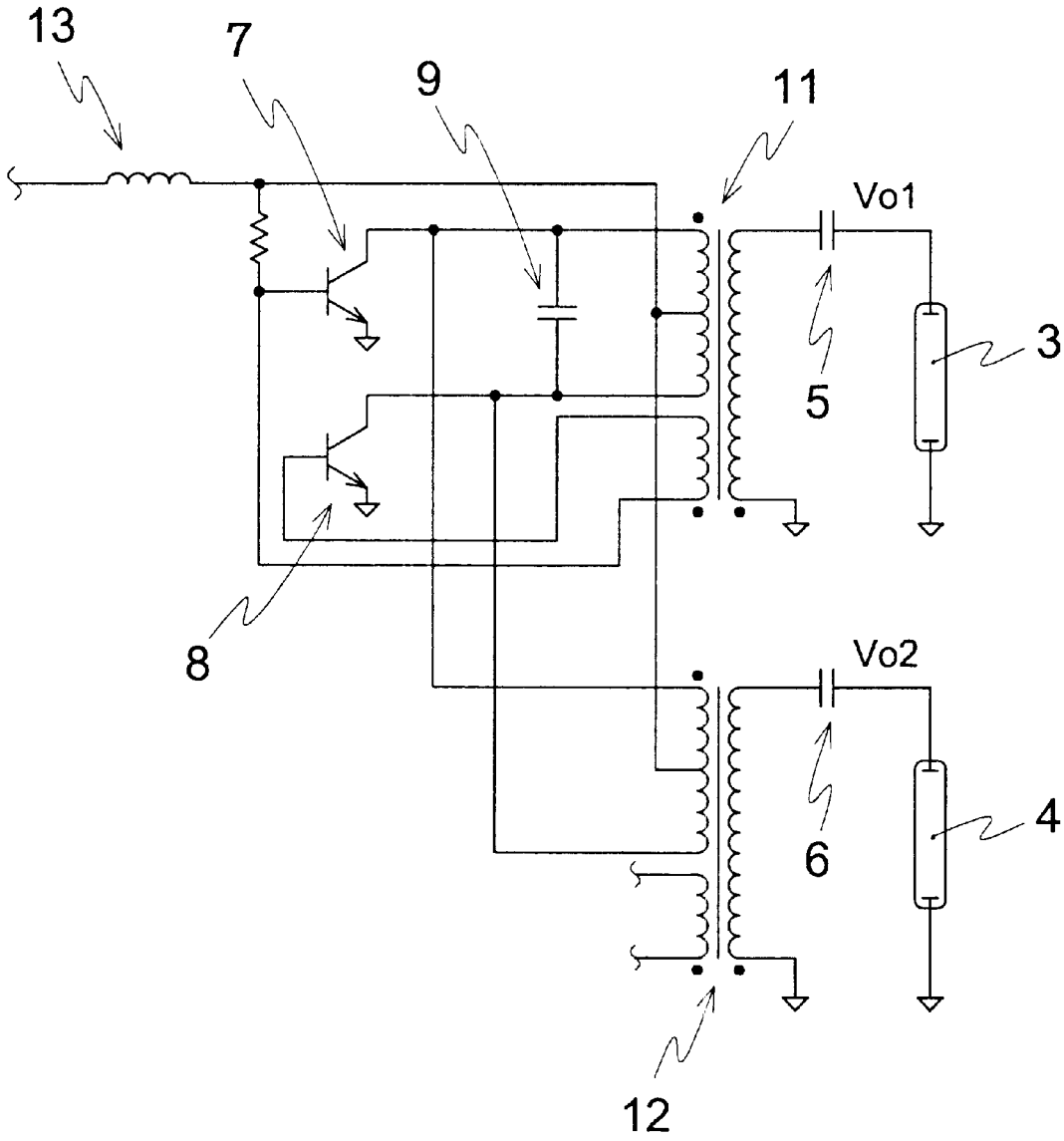
FIG. 6 PRIOR ART
FIG. 6 illustrates a view of a circuit of a conventional inverter.
Figure 7:
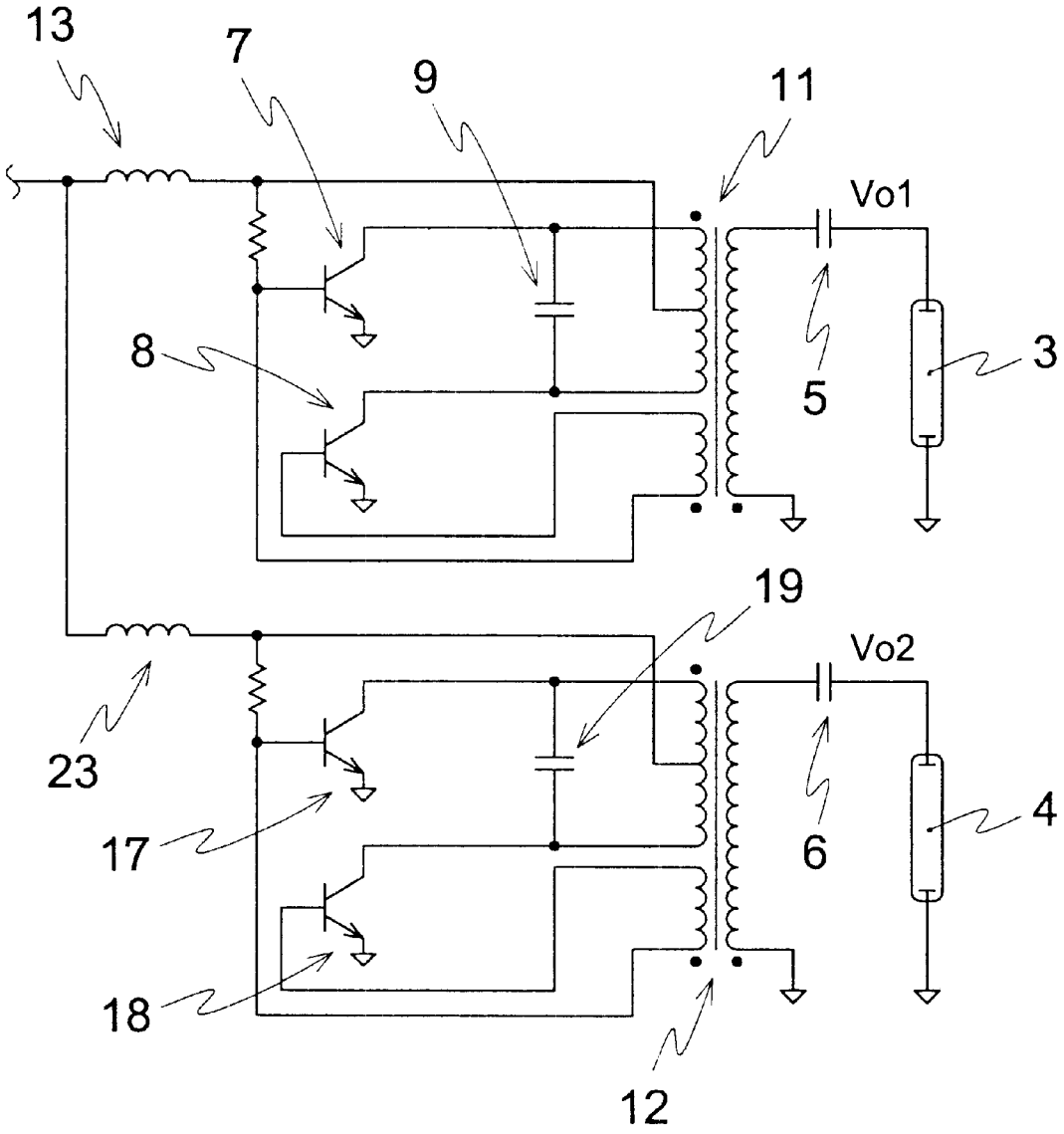
FIG. 7 PRIOR ART
FIG. 7 illustrates a view of a circuit of a conventional inverter.
Figure 8:
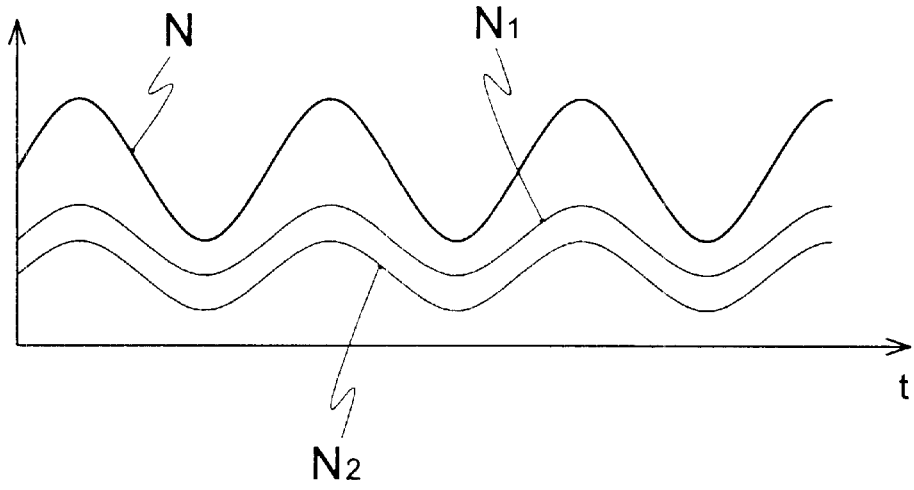
FIG. 8 PRIOR ART
FIG. 8 illustrates high voltage noise waveforms of a conventional inverter.
Figure 9:
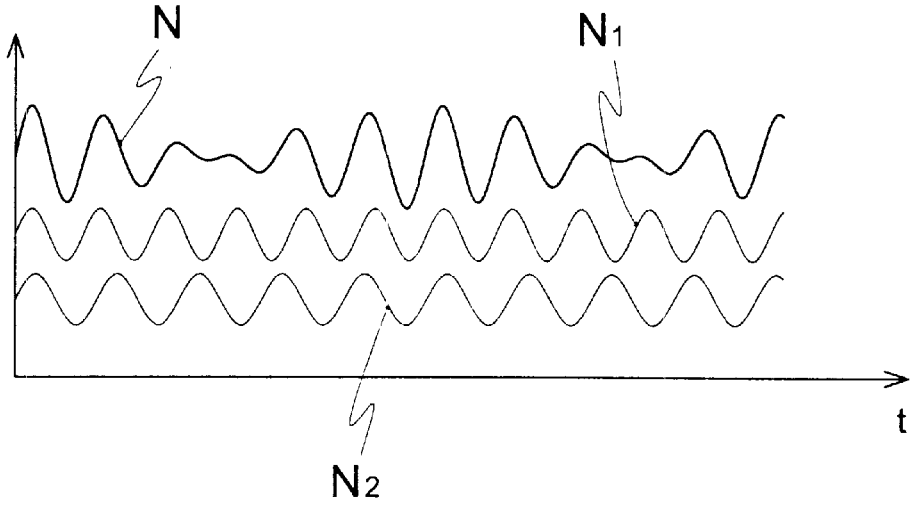
FIG. 9 PRIOR ART
FIG. 9 illustrates high voltage noise waveforms of a conventional inverter.
Figure 10:
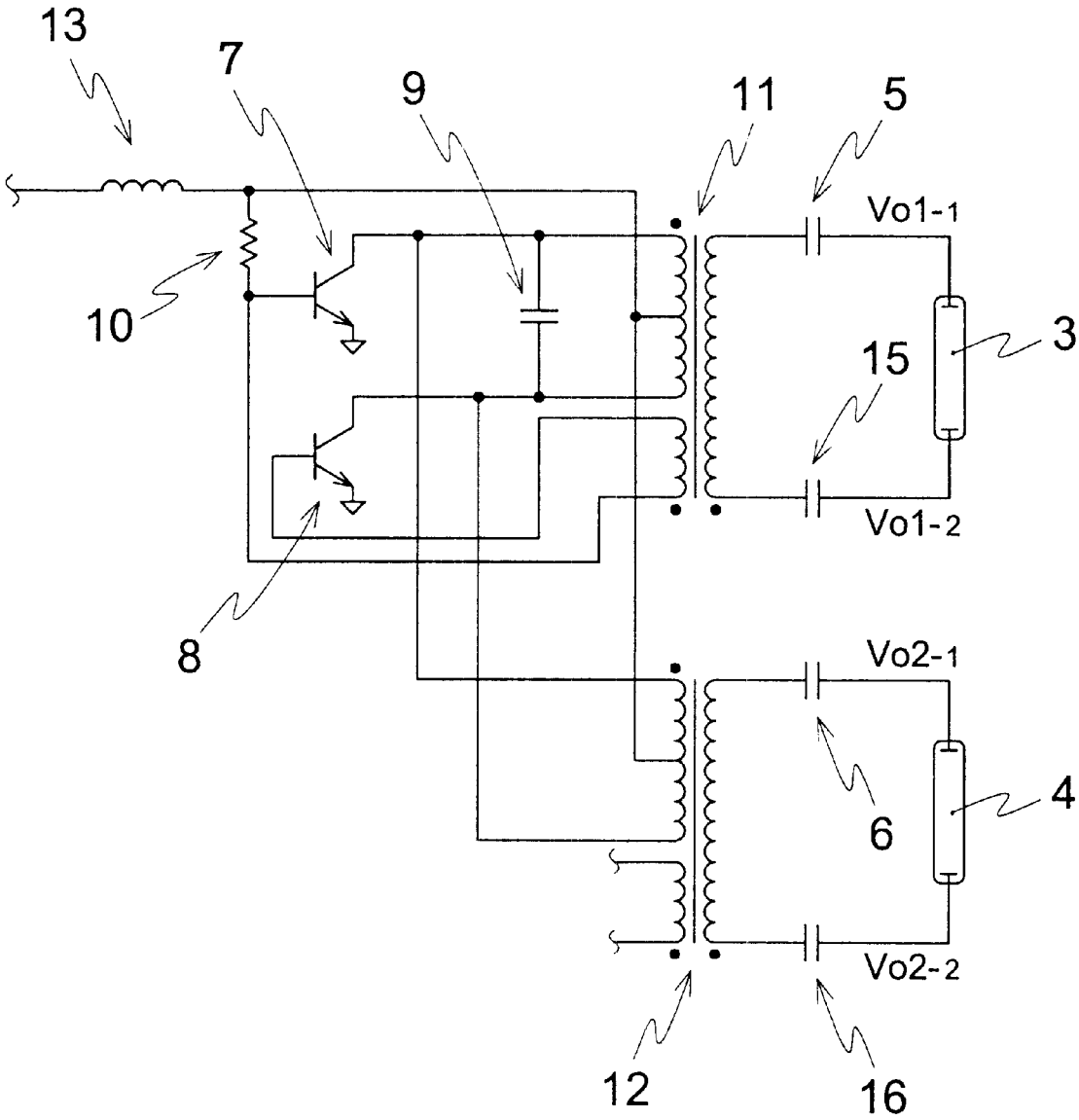
FIG. 10 PRIOR ART
FIG. 10 illustrates a view of a circuit of a conventional inverter.

As illustrated in FIG. 4, by connecting a plurality of inverters in parallel each comprised with two step-up transformers for outputting outputs of identical frequency but of reverse phases, a backlight comprised of a plurality of cold cathode tubes can be driven and illuminated without generating display noise owing to high voltage output of the inverters.

While FIG. 4 illustrates an example in which the applied inverter is employing the Royer's circuit (Embodiment 1), it is alternatively possible to apply an inverter employing a externally excited type inverter (Embodiment 2).

A plurality of cold cathode tubes may be respectively connected to the respective step-up transformers.

The inverter for a multi-tube type backlight of the present invention is comprised with two step-up transformers of one-side grounded type in which one end of a secondary winding is grounded, wherein the respective step-up transformers respectively output electric power to one or a plurality of cold cathode tubes, and since outputs of the respective step-up transformers are set to be of mutually reversed phases, noise resulting from secondary-side high voltage outputs of the respective step-up transformers will be cancelled such that the composite noise becomes zero, and it is accordingly possible to prevent beat noise appearing on a liquid crystal display panel.

What is claimed is:

1. An inverter for multi-tube type backlight including two step-up transformers of one-side grounded type, wherein the two step-up transformers respectively output electric power to one or a plurality of cold cathode tubes, and wherein outputs of the two step-up transformers are of identical frequency but of mutually reversed phases.

2. An inverter for multi-tube type backlight including two step-up transformers of one-side grounded type, wherein the two step-up transformers respectively output of cold cathode tubes, wherein a primary-side resonance circuit is used in common by said two step-up transformers, and wherein said two step-up transformers are set to be of reverse polarity, whereby outputs of said two step-up transformers are of identical but of mutually reversed phases.

3. An inverter for multi-tube type backlight including two step-up transformers of one-side grounded type, wherein said two step-up transformers respectively output electric power to one or a plurality of cold cathode tubes, wherein said two step-up transformers of one-side grounded type are driven in a push-pull manner through identical switching signals, and wherein polarities of said two step-up transformers and switching elements into which said switching signals and the signals obtained by inverting said switching signals are determined such that outputs of said two step-up transformer are of reverse phase.

4. An inverter for multi-tube type backlight comprising a plurality of said inverters of claims 1, 2 or 3.

* * * * *